US006283144B1

(12) United States Patent
Kahn

(10) Patent No.: US 6,283,144 B1
(45) Date of Patent: Sep. 4, 2001

(54) CEILING WATER LEAK DAMAGE COLLECTOR UNIT

(76) Inventor: Mackey Kahn, 33-47 166$^{th}$ St., Flushing, NY (US) 11358

( * ) Notice: Subject to any disclaimer, the term of this patent is extended or adjusted under 35 U.S.C. 154(b) by 0 days.

(21) Appl. No.: 09/507,615

(22) Filed: Feb. 21, 2000

(51) Int. Cl.$^{7}$ ..... B67C 11/00

(52) U.S. Cl. ..... 137/357; 137/15.11; 137/312; 141/86; 141/337

(58) Field of Search ..... 137/15.11, 312, 137/357; 141/86, 98, 337

(56) References Cited

U.S. PATENT DOCUMENTS

| | | | | |
|---|---|---|---|---|
| 2,410,338 | | 10/1946 | Craine . | |
| 3,481,632 | | 12/1969 | Suess . | |
| 4,022,257 | * | 5/1977 | O'Connell | 141/98 |
| 4,651,494 | | 3/1987 | Van Wagoner . | |
| 4,719,723 | | 1/1988 | Van Wagoner . | |
| 5,172,718 | * | 12/1992 | Thornburgh | 137/312 |
| 5,289,664 | | 3/1994 | Rizza et al. . | |
| 5,299,591 | * | 4/1994 | Duncan | 137/15.11 |
| 5,317,852 | | 6/1994 | Howland . | |
| 5,394,666 | | 3/1995 | Zahner . | |
| 5,522,197 | | 6/1996 | Ebeling . | |
| 5,526,900 | * | 6/1996 | Mason | 141/86 |
| 5,829,214 | | 11/1998 | Hart . | |

* cited by examiner

*Primary Examiner*—J. Casimer Jacyna
(74) *Attorney, Agent, or Firm*—Gordon D. Coplein

(57) ABSTRACT

A collector unit to be attached to a ceiling to collect leaking water and falling debris is formed by a sheet of water impervious material, preferably foldable and flexible, and having a generally concave shape with an outlet drain at a lower part. A net is fastened to the sheet across its open top. The unit is fastened to a ceiling and leaking water passes through the net, flows in the sheet to the outlet drain and it is conveyed away from the collector unit through a drain line connected to the outlet drain. Debris falling from the ceiling is caught by the net so that it does not reach the sheet and clog the outlet drain. The sheet and net are preferably of a material such that the collector unit can be folded into a package.

8 Claims, 2 Drawing Sheets

CEILING WATER LEAK DAMAGE COLLECTOR UNIT

FIELD OF THE INVENTION

The present invention relates to a device for collecting water and debris from a leaking or otherwise damaged ceiling for preventing damage to other parts of a building.

BACKGROUND OF THE INVENTION

Situations occur wherein water leaks from a ceiling and causes damage to the room in which the ceiling is located. For example, in an apartment building or home, water can overflow from a bath or broken pipe. If the condition is not quickly corrected, the water will travel through the floor of the bathroom containing the overflowing bath or flow from the broken pipe to the ceiling of the floor below. This damages the ceiling of the room in the floor below. If the water reaching the ceiling is not contained it will flow from the ceiling into the room and cause further damage to the walls, floor and contents of the room. Also, pieces of the ceiling can become detached due to the water and cause further damage in the room.

A similar situation occurs when there is a roof leak. A heavy storm can produce substantial quantifies of water. Often times the roof cannot be repaired promptly and the room below the leaking roof can be severely damaged over a period of time. Therefore, a need exists for a device that can collect the water and debris from a ceiling and prevent damage to the room.

BRIEF DESCRIPTION OF THE INVENTION

The present invention relates to a device for protecting a building space, such as a room or other part of a building, and its contents from damage or minimizing damage caused by the water in the floor or roof above the space which flows into the ceiling of the space. In accordance with the invention an inverted umbrella like collector unit is provided that is to be attached to the ceiling encompassing the area where the water is damaging the ceiling. The collector includes a sheet of material which is substantially water impervious and is preferably flexible and foldable. The sheet is generally concave and has an outlet drain at a lower point. Water flowing from the ceiling into the collector proceeds to the outlet drain to which is connected an external drain line which conveys the collected water to a desired location, such as a sewer, which is outside the building space.

A net, also preferably of flexible material, is stretched across the wider open entry part of the collector sheet so as to be positioned adjacent the ceiling. Any debris falling from the ceiling, such as pieces of the ceiling plaster or wallboard, is caught by the net so that it does not contact the collector sheet to damage it or to block the collector outlet drain.

When the ceiling water flow situation is over, the drain line is disconnected from the outlet drain and the collector unit is detached from the ceiling and folded for removal. The sheet material and net of the collector, both of which are made of relatively inexpensive materials, can be disposed of. Any debris trapped in the net can be folded into the collector or first removed from the unit for separate disposal. Since the sheet and net are of flexible and foldable material, the entire collector unit can be folded into a compact package. The drain line attached to the sheet can be connected to another collector unit and reused.

OBJECT OF THE INVENTION

It is an object of the invention to provide a collector unit to be attached to a ceiling of a building space to collect water and debris therefrom.

Another object is to provide a collector unit to be attached to a damaged ceiling to collect water flowing from it and to direct the collected water to an external disposal point.

Still a further object is to provide a collector unit to be attached to a damaged ceiling of a building space such as a room or hallway from which water is flowing and to which a drain line is attached to convey the water collected to a disposal point.

Yet another object is to provide a collector unit of a flexible and foldable sheet material to be attached to a ceiling to collect water flow and which has a net to trap debris falling from the ceiling to prevent blockage of an outlet drain of the collector unit.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
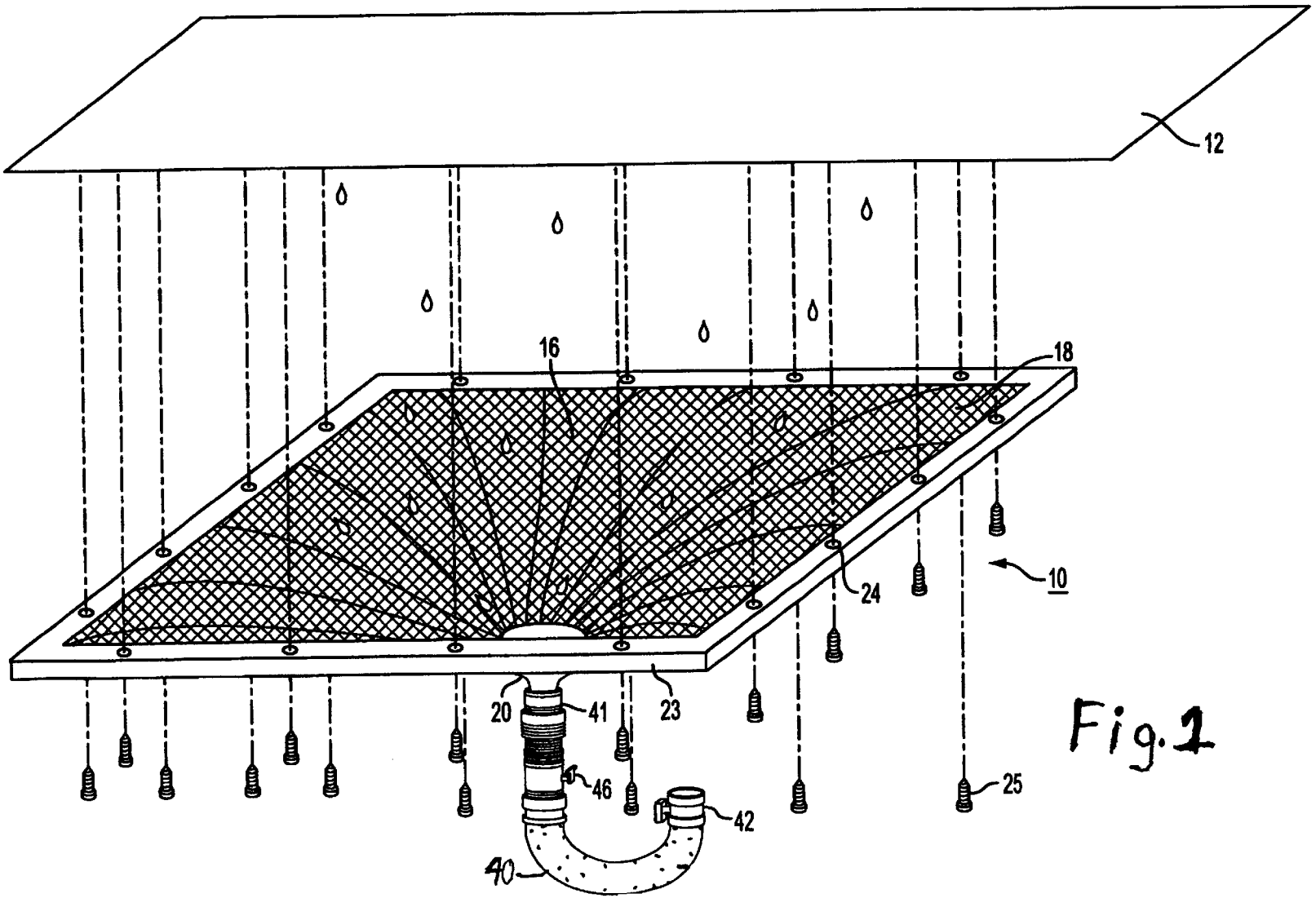
FIG. 1 is a part perspective and part elevational view of the collector unit of the invention.
Figure 2:
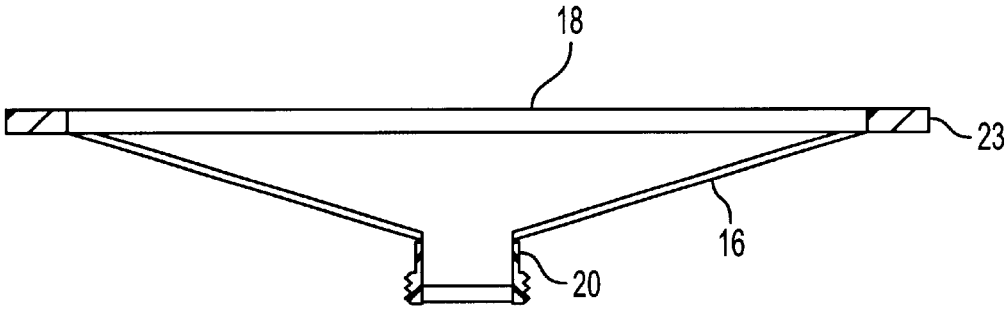
FIG. 2 is a cross sectional view of a portion of the collector unit.

Referring to the drawings, the collector unit is shown generally by the numeral 10. It is shown under a portion of a ceiling 12 to which it is to be attached. The ceiling portion is damaged and either or both of the conditions exist of water flowing from the ceiling and/or pieces of debris falling. The collector unit 10 is illustratively shown of generally square shape although any suitable shape, regular, such as a circle or rectangle, or irregular, can be used. The collector unit also can be if any desired size, a typical size being 5 feet by 5 feet.

The collector unit includes a sheet 16 and a net 18. The sheet 16 is of water impervious material, such as a polyvinyl plastic, that is of a suitable thickness to provide the required strength. The outer periphery of the sheet determines the overall shape of the collector unit. The sheet 16 also is formed so that it is somewhat concave, or bowl shaped, in the vertical direction. That is, the sheet has somewhat of an inverted umbrella like shape. The concavity of the sheet does not have to be regular. That is, one part of the sheet can have a steeper or gentler slope than another.

An outlet drain 20 is provided at a lower, preferably the lowermost, point of the sheet 16. The outlet drain 20 can be of plastic or other suitable material and is preferably is permanently attached to the sheet opening by any suitable arrangement. For example, the outlet drain upper portion can have a plastic collar that is heat sealed or adhesively affixed to the sheet. If desired, the outlet drain 20 can be provided as a separate piece. The portion of the outlet drain that extends outwardly of the sheet 16 is formed with a connector arrangement, such as a screw or bayonet type connector, to afford connection of an external drain system 40. The inner diameter of the outlet drain 20 can be selected as desired. A 2 inch diameter for the outlet drain and drain line is considered to be satisfactory for most applications. Any suitable size can be used.

A mesh type net 18 is placed across the upper open entry part of the sheet 16. The periphery of the net 18 is attached to the periphery of the sheet 16. The net also preferably is of a flexible foldable material. If the net material is of plastic, then its periphery can be heat sealed or ultrasonic welded to the periphery of a plastic sheet 16. Any suitable material can be used for the net and the method of fastening, such as by an adhesive or stitching, depends on the materials used for the sheet and net.

In the preferred embodiment of the invention, a band 23 of flexible reinforcing material is placed around the collector unit outer periphery. This can be placed over the periphery of the net and the band, and the band, net and sheet all sealed together at the same time. The band 23 can be of any suitable material, preferably of strong fabric or plastic to add strength to the periphery of the unit when suspended from a ceiling.

The net 18 is sized relative to the sheet top opening or is made of a somewhat flexible material so that there will be an amount of "give" of the net. I.e., it will depress downwardly, when debris fall onto it. However, the net is made sufficiently strong so that it will not depress downwardly far enough to block the inlet to the unit outlet drain 20. The mesh openings of the net can be of any desired size. A typical opening size could be, for example about ½–⅜ inch. Pieces of material passing though this size mesh opening will not be large enough to clog a drain of 2 inch diameter.

Suitable fasteners 25, such as nails or screws, are inserted through the sandwich of band, net and sheet to fasten the collector unit to the ceiling. If desired, and as illustratively shown, a plurality of holes 24 are made around the periphery to permit passage of the fasteners. The holes 24 preferably are spaced apart by a distance corresponding to normal spacing of structural members above the ceiling, such as 16 or 24 inches on center to correspond to normal layout of building studs. The holes 24 also can be reinforced with washers or grommets. Also, if desired, the fasteners 25 can be captivated in the holes 24 so that the collector unit does not require use of fasteners provided from an external supply. The holes 24 are not essential. That is, the fasteners can be passed directly though the sheet material.

A drain line assembly 40 is to be attached to the outlet drain 20 of the collector. The inlet end 41 of the drain line has the connectors needed to connect it to the collector unit outlet drain 20. The drain line assembly has the necessary components, such as connectors and joints, to provide an outlet end 42 which can accept a hose to discharge collected water to a location, usually remote from the collector unit, where it will not cause damage. A petcock 46 preferably is provided on the drain line at a position near the collector unit outlet drain so that the liquid passing into the collector unit outlet drain 20 can be withdrawn and examined if desired. An adaptor can be provided on the end of the outlet drain 20 or on the drain line 40 to accept a reduced diameter hose, such as a ⅝' or ¾' standard garden hose. Such a hose, for example of a length of 8–10 feet or other suitable length, can be packaged as part of the unit.

In use, the collector unit 10 is provided in a folded form, such as in a package or bag, without the drain line assembly 40 attached. The package is opened and the unit laid out. The periphery of the unit is fastened to the ceiling by inserting the fasteners 25 though the holes 24 into the ceiling with the collector sheet upper opening surrounding the damaged part of the ceiling. The drain line 40 is connected to the collector outlet drain 20. A hose can be connected to the drain line 40 ortho the outlet drain 20. Any water flowing from the ceiling part surrounded by the collector passes through the net 18 onto the sheet 16 and flows downwardly to leave the collector unit though the outlet drain 20 into the drain assembly line 40 for discharge to a remote location. Any debris falling from the ceiling is trapped on the net 18 thereby preventing it from clogging the outlet drain 20.

The collector unit remains in place during the time that the water condition that caused the leakage is being corrected or some other suitable time. It is taken down from the ceiling by first disconnecting the drain line 40 and then removing the fasteners 25. The collector unit then can be folded with any debris caught by the net or after first removing the debris. Since the collector can be made of relatively inexpensive materials it can be disposed of when its use at a location is completed.

Specific features of the invention are shown in one or more of the drawings for convenience only, as each feature may be combined with other features in accordance with the invention. Alternative embodiments will be recognized by those skilled in the art and are intended to be included within the scope of the claims. Accordingly, the above description should be construed as illustrating and not limiting the scope of the invention. All such obvious changes and modifications are within the patented scope of the appended claims.

What is claimed is:

1. A collector unit to be fastened to and for collecting liquid and debris from a damaged ceiling comprising:

a sheet of foldable material of generally concave shape to be fastened to the ceiling with its open top surrounding a damaged ceiling area;

a mesh net of foldable material fastened around and adjacent to the peripheral edge of said sheet to cover substantially the entire open top of said sheet when the unit is fastened to the ceiling, the sheet and net being foldable together; and a liquid outlet drain at a lower portion of said sheet.

2. A collector unit as in claim 1 further comprising a band of reinforcing material around the periphery of said sheet through which fasteners are to pass to attach said collector unit to the ceiling.

3. A collector unit as in claim 1 further comprising a drain line for connection to said outlet drain.

4. A collector unit as in claim 3 further comprising a petcock in said drain line.

5. A collector unit as in claim 1 wherein said sheet is of plastic material.

6. A collector unit as in claim 1 wherein both said sheet and net are of plastic material.

7. A collector unit as in claim 1 further comprising a band of reinforcing material around the periphery of said sheet fastening said sheet and said net together.

8. A collector unit as in claim 7 wherein said band is formed with openings through which fasteners are to pass to attach said collector unit to the ceiling.

* * * * *